US007699126B2

(12) United States Patent
Boudrare et al.

(10) Patent No.: US 7,699,126 B2
(45) Date of Patent: Apr. 20, 2010

(54) CUTTING ELEMENT HAVING ASYMMETRICAL CREST FOR ROLLER CONE DRILL BIT

(75) Inventors: Mohammed Boudrare, Houston, TX (US); Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 323 days.

(21) Appl. No.: 11/758,341

(22) Filed: Jun. 5, 2007

(65) Prior Publication Data

US 2007/0278015 A1 Dec. 6, 2007

Related U.S. Application Data

(60) Provisional application No. 60/810,949, filed on Jun. 5, 2006.

(51) Int. Cl.
*E21B 10/16* (2006.01)

(52) U.S. Cl. ..... 175/374; 175/378; 175/426

(58) Field of Classification Search ..... 175/374, 175/378, 426

See application file for complete search history.

(56) References Cited

U.S. PATENT DOCUMENTS

| | | | | |
|---|---|---|---|---|
| 3,442,342 | A * | 5/1969 | Cunningham et al. | 175/374 |
| 5,172,777 | A * | 12/1992 | Siracki et al. | 175/374 |
| 2003/0034179 | A1 * | 2/2003 | Singh | 175/374 |
| 2004/0163851 | A1 * | 8/2004 | McDonough et al. | 175/374 |
| 2004/0173384 | A1 * | 9/2004 | Yong et al. | 175/374 |
| 2005/0023043 | A1 * | 2/2005 | Tufts | 175/374 |
| 2007/0095577 | A1 * | 5/2007 | Griffo et al. | 175/374 |
| 2008/0060852 | A1 * | 3/2008 | Chandila et al. | 175/374 |

* cited by examiner

*Primary Examiner*—Hoang Dang

(57) ABSTRACT

A drill bit for drilling a borehole includes a cutter element comprising a base portion. In addition, the cutter element comprises a cutting portion extending from the base portion and terminating in an elongate crest extending between a first crest end and a second crest end, and having an intermediate portion therebetween. The first crest end has a width $W_1$ and the second end has a width $W_2$ that is greater than the width $W_1$. Still further, the intermediate portion of the crest has a width $W_3$ that is less than the width $W_2$ and less than or equal to the width $W_1$.

49 Claims, 9 Drawing Sheets

CUTTING ELEMENT HAVING ASYMMETRICAL CREST FOR ROLLER CONE DRILL BIT

CROSS-REFERENCE TO RELATED APPLICATIONS

This application claims benefit of U.S. provisional application Ser. No. 60/810,949 filed Jun. 5, 2007, and entitled "Cutting Element Having Asymmetrical Crest For Roller cone Drill Bit," which is hereby incorporated herein by reference in its entirety.

STATEMENT REGARDING FEDERALLY SPONSERED RESEARCH OR DEVELOPMENT

Not Applicable

BACKGROUND OF THE INVENTION

1. Field of the Invention

The invention relates generally to earth-boring bits used to drill a borehole for the ultimate recovery of oil, gas or minerals. More particularly, the invention relates to rolling cone rock bits and to an improved cutting structure and cutting element for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip"of the drill string, requires considerable time, effort and expense. Because drilling costs are typically thousands of dollars per hour, it is thus always desirable to employ drill bits which will drill faster and longer and which are usable over a wider range of formation hardness. The length of time that a drill bit may be employed before it must be changed depends upon its ability to "hold gage" (meaning its ability to maintain a full gage borehole diameter), its rate of penetration "ROP"), as well as its durability or ability to maintain an acceptable ROP.

One common earth-boring bit includes one or more rotatable cone cutters that perform their cutting function due to the rolling movement of the cone cutters acting against the formation material. The cone cutters roll and slide upon the bottom of the borehole as the bit is rotated, thereby engaging and disintegrating the formation material in their path. The rotatable cone cutters may be described as generally conical in shape and are therefore sometimes referred to as rolling cones, cone cutters, or the like. The borehole is formed as the gouging and scraping or crushing and chipping action of the rotary cones removes chips of formation material which are carried upward and out of the borehole by drilling fluid which is pumped downwardly through the drill string and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters break up the formation to form a new borehole by a combination of gouging and scraping or chipping and crushing. The shape and positioning of the cutter elements (both steel teeth and tungsten carbide inserts) upon the cone cutters greatly impact bit durability and ROP and thus, are important to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface configured and positioned so as to align generally with and ream the sidewall of the borehole as the bit rotates. Conventional bits also typically include a circumferential gage row of cutter elements mounted adjacent to the heel surface but oriented and sized in such a manner so as to cut the corner of the borehole. Still further, conventional bits typically include a number of inner rows of cutter elements that are located in circumferential rows disposed radially inward or in board from the gage row. These cutter elements are sized and configured for cutting the bottom of the borehole, and are typically described as inner row or bottomhole cutter elements.

Inner row inserts in TCI bits have been provided with various geometries. One insert typically employed in an inner row may generally be described as a "conical" insert one having a cutting surface that tapers from a cylindrical base to a generally rounded or spherical apex. Such an insert is shown, for example, in FIGS. 4A-C in U.S. Pat. No. 6,241,034. Another common shape for an insert for use in inner rows is what generally may be described as a "chisel" shaped insert. Rather then having the spherical apex of the conical insert, a chisel insert generally includes two generally flattened sides or flanks that converge and terminate in an elongate crest at the terminal end of the insert. The chisel element may have rather sharp transitions where the flanks intersect the more rounded portions of the cutting surface, as shown, for example, in FIGS. 1-8 in U.S. Pat. No. 5,172,779. In other designs, the surfaces of the chisel insert may be contoured or blended so as to eliminate sharp transitions and to present a more rounded cutting surface, such as shown in FIGS. 3A-D in U.S. Pat. No. 6,241,034 and FIGS. 9-12 in U.S. Pat. No. 5,172,779. In general, it has been understood that, as compared to a conical inset, the chisel shaped insert provides a more aggressive cutting structure that removes formation material at a faster rate for as long as the cutting structure remains intact. For this reason, in soft formations, chisel shaped inserts are frequently preferred for bottom hole cutting.

Despite this known advantage of chisel shaped inserts, however, such cutter elements have shortcomings when it comes to drilling in harder formations, where the relatively sharp cutting edges and ends of the chisel endure high stresses that may lead to chipping and ultimately breakage of the insert. Likewise, in hard and abrasive formations, the chisel crest may wear dramatically. Both wear and breakage may cause a bit's ROP to drop dramatically, as for example, from 80 feet per hour to less than 10 feet per hour. Once the cutting structure is damaged and the rate of penetration is reduced to an unacceptable rate, the drill string must be removed in order to replace the drill bit. As mentioned, this "trip" of the drill string is extremely time consuming and expensive to the driller.

Another known phenomena detrimental to drill bit life and ROP is a abrasive wear that tends to wear away and flatten the cutter element on the side generally facing the borehole wall. As this wear occurs, the cutter element removes less formation material with each strike of the insert against the formation, typically leading to reduced ROP. In addition, wear may result in greater side wall forces imparted on the bit. Such increased loads tend to place greater demands and stresses on the bearings and may lead to bit instability and wobble which, in turn, may cause the bit to deviate from its intended drilling path. Further, as the surface of the insert facing the borehole wall tends to wear toward the center of the chisel structure (i.e., the chisel structure wears from the outer edge towards the center), the insert becomes sharper, and more likely to chip and ultimately to break.

Accordingly, there remains a need in the art for a drill bit and cutting elements that will provide a relatively high rate of penetration and footage drilled, yet be durable enough to withstand hard and abrasive formations. Such drill bits and cutting elements would be particularly well received if they had geometries adapted to resist such off center wear, and further, when such wear nevertheless does occur, to resist the tendency for the cutter element to break.

SUMMARY OF SOME OF THE PREFERRED EMBODIMENTS

In accordance with at least one embodiment of the invention, a cutter element for a drill bit comprises a base portion. In addition, the cutter element comprises a cutting portion extending from the base portion and terminating in an elongate crest extending between a first crest end and a second crest end, and having an intermediate portion therebetween. The first crest end has a width $W_1$ and the second end has a width $W_2$ that is greater than the width $W_1$. Still further, the intermediate portion of the crest has a width $W_3$ that is less than the width $W_2$ and less than or equal to the width W.

In accordance with other embodiments of the invention, a cutter element for a drill bit comprises a base portion including a cutter element axis. In addition, the cutter element comprises a cutting portion extending from the base portion and terminating in an elongate crest having a top crest profile in top view, the top crest profile including a first profile end, a second profile end, and an intermediate profile region therebetween. The first profile end has a profile radius $R_1$ and the second profile end has a profile radius $R_2$ that is greater than the profile radius $R_1$. Moreover, the intermediate profile region of the top crest profile includes a concave portion defined by at least one radius that is inverted relative to the profile radius $R_1$ and the profile radius $R_2$.

In accordance with another embodiment of the invention, a drill bit for drilling a borehole having a predetermined full gage diameter comprises a bit body having a bit axis. In addition, the drill bit comprises a first rolling cone cutter rotatably mounted on the bit body for rotation about a cone axis. Further, the drill bit comprises at least one cutter element mounted on the first rolling cone cutter. The cutter element comprises a cutting surface including a pair of frustoconical lateral end surfaces and at least one flanking surface disposed between the lateral end surfaces, the first and second end surfaces and the flanking surface intersecting to form an elongate crest having a first crest end and a second crest end. Still further, the crest defines a top crest profile having a width $W_j$ at the first crest end, a width $W_2$ at the second crest end, and a width $W_3$ at an intermediate profile region between the first crest end and the second crest end. Moreover, width $W_2$ is greater than width $W_1$ and greater than width $W_3$, and wherein width $W_3$ is less than or equal to $W_1$.

In accordance with another embodiment of the invention, a drill bit having a gage diameter for drilling a borehole in earthen formations comprises a bit body having a bit axis. In addition, the drill bit comprises a rolling cone cutter rotatably mounted on the bit body for rotation about a cone axis. Further, the drill bit comprises a first plurality of cutter elements mounted on the rolling cone cutter, each of the first plurality of cutter elements having a base portion retained in the cone cutter and a cutting portion extending from the base and terminating in an elongate crest extending along a crest median line between a first crest end and a second crest end, and having an intermediate portion between the first crest end and the second crest end. Still further, each of the first and second crest ends has a crest end radius in front view, and wherein the crest end radius of the first crest end is smaller than the crest end radius of the second crest end.

Thus, the embodiments described herein comprise a combination of features and characteristics which are directed to overcoming some of the shortcomings of prior bits and cutter element designs. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
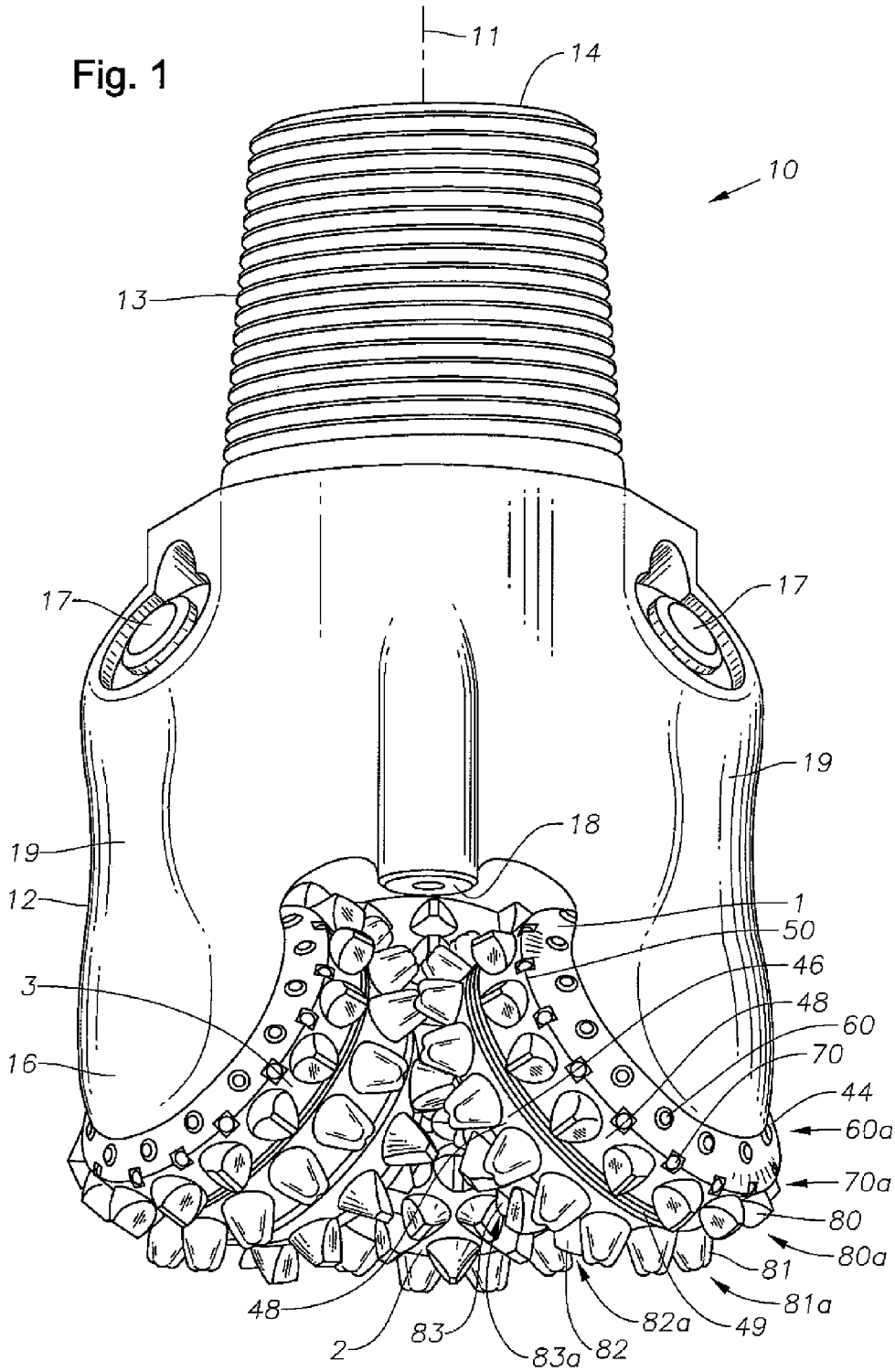
FIG. 1 is a perspective view of an earth-boring bit.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . "Also, the term "couple" or "couples" is intended to mean either an indirect or direct connection. Thus, if a first device couples to a second device, that connection may be through a direct connection, or through an indirect connection via other devices and connections.

Referring to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
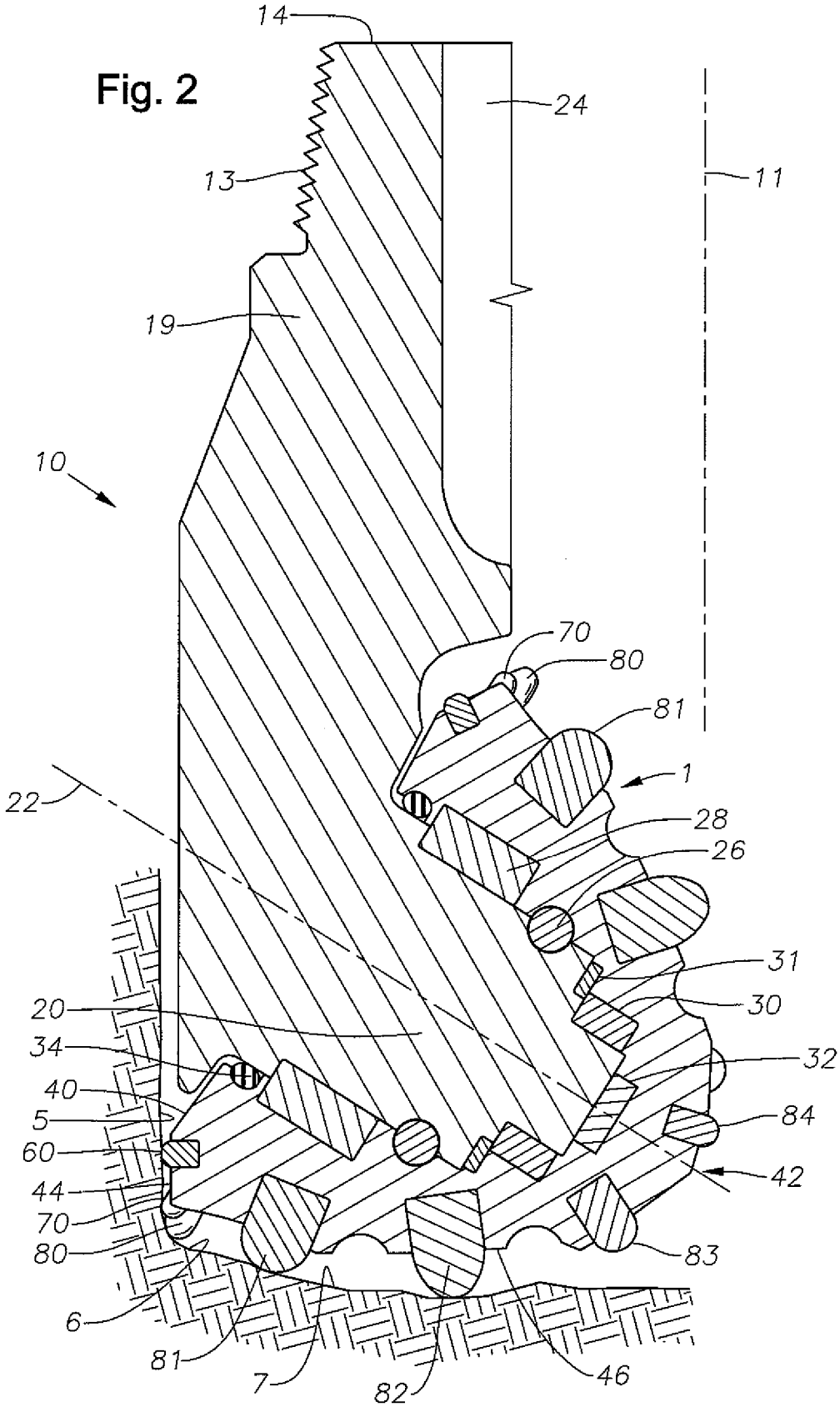
FIG. 2 is a partial section view take through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose portion 42. Adjacent to backface 40, each cutter 1-3 further includes a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally fustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 70, 80 function primarily to cut the corner 6 of the borehole. Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters.

Inserts 60, 70, 80-83 each generally include a cylindrical base portion having a central axis, and a cutting portion that extends from the base portion and includes a cutting surface for cutting the formation material. The base portion is secured by interference fit into a mating socket drilled into the surface of the cone cutter.

A cutter element 100 is shown in FIGS. 3-6 and is believed to have particular utility when employed as an inner row cutter element, such as in inner rows 81*a* or 82*a* shown in FIGS. 1 and 2 above. However, cutter element 100 may also be employed in a gage or heel region, such as in heel row 60*a* and/or gage rows 70*a*, 70*b* shown in FIGS. 1 and 2.

Figure 4:
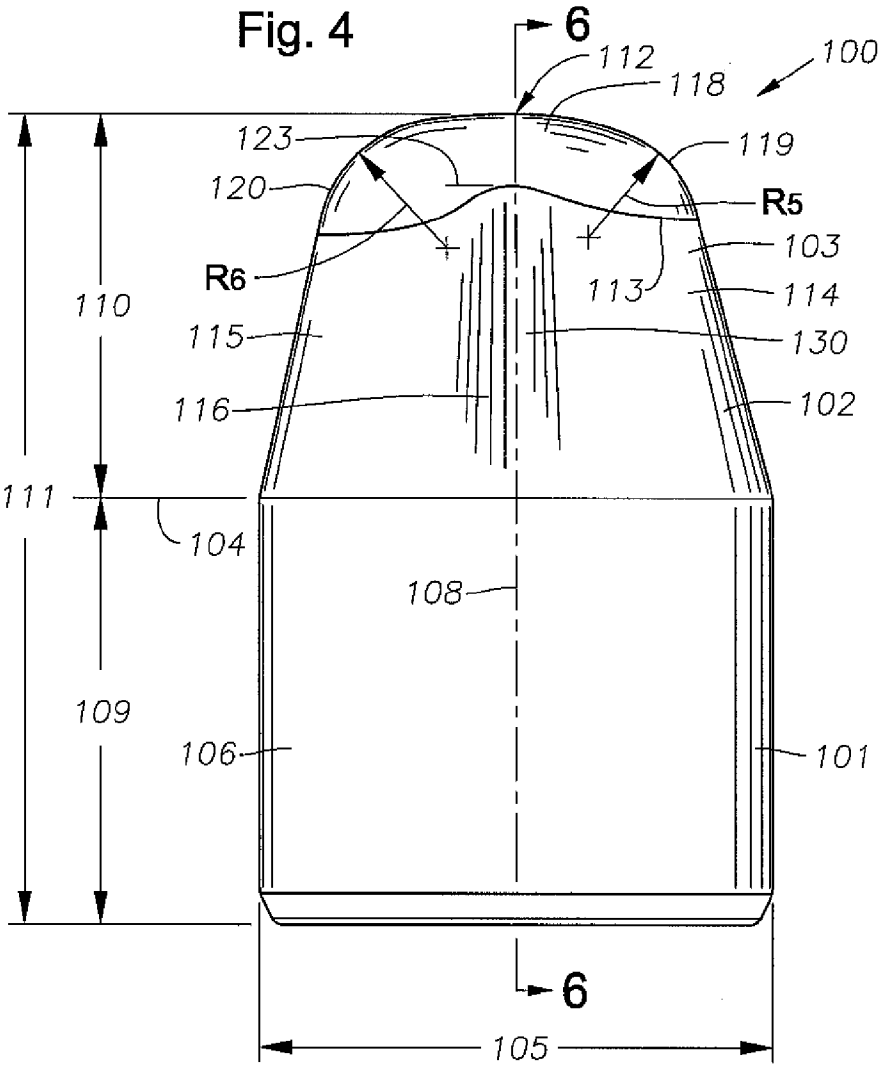
FIG. 4 is a front elevation view of the cutter element shown in FIG. 3.
Figure 5:
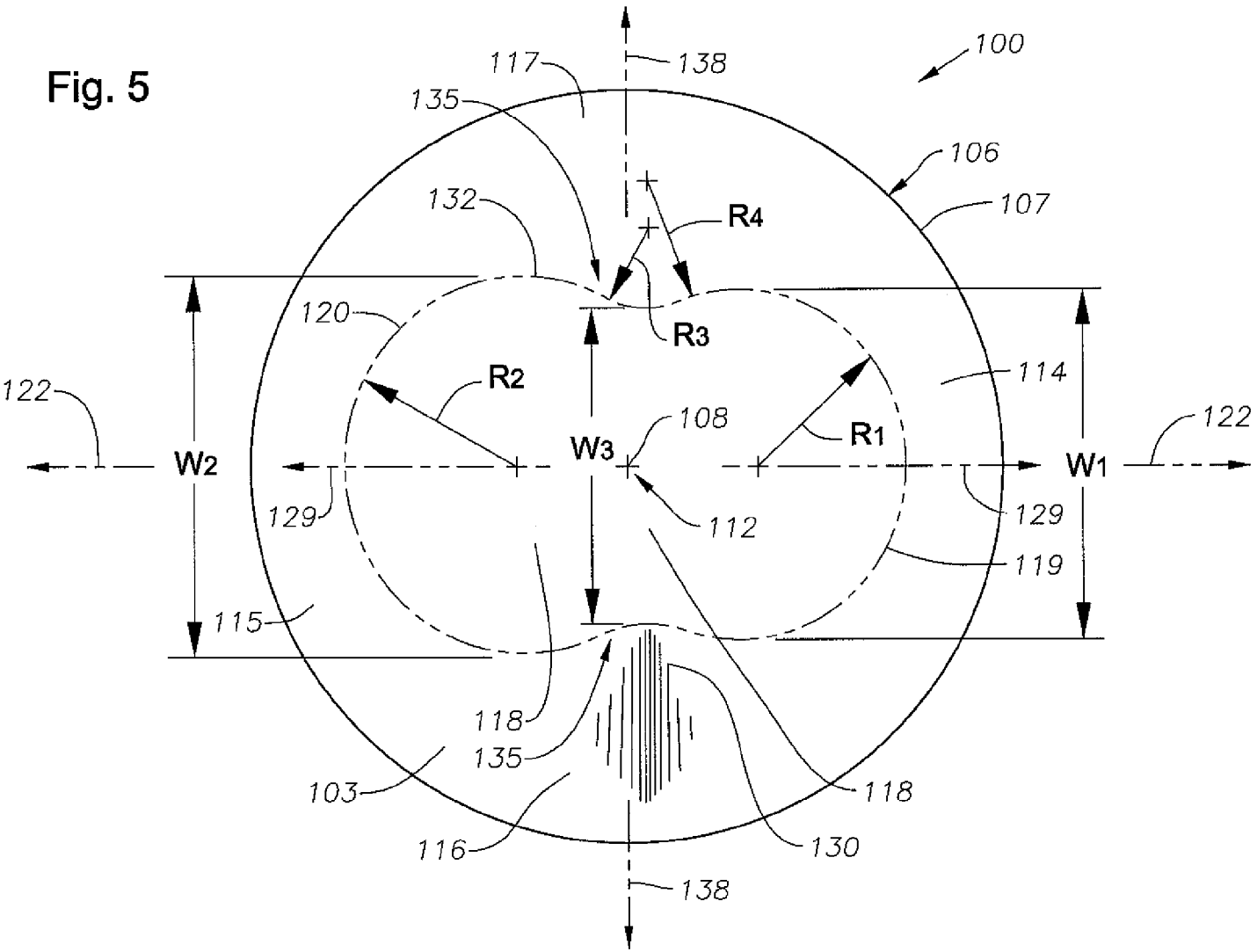
FIG. 5 is a top view of the cutter element shown in FIG. 3.

Referring now to FIGS. 3-6, cutter element or insert 100 includes a base portion 101 and a cutting portion 102 extending therefrom. Cutting portion 102 includes a cutting surface 103 extending from a plane of intersection 104 that generally divides base portion 101 and cutting portion 102. In this embodiment, base portion 101 is generally cylindrical, having a diameter 105, a central axis 108 and an outer surface 106 defining an outer circular profile or footprint 107 of the insert (FIG. 5). As best shown in FIG. 4, base portion 101 has a height 109, and cutting portion 102 extends from base portion 101 so as to define an extension height 110. Collectively, base 101 and cutting portion 102 define the insert's overall height 111. Although base portion 101 is cylindrical in this embodiment in general, base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of cutter element 100 generally represents the distance from the cone surface to the outermost point of cutting surface 103 as measured parallel to the insert's axis 108 and perpendicular to the cone surface.

Cutting surface 103 is preferably continuously contoured. As used herein, the phrase "continuously contoured" may be used to describe surfaces that are smoothly curved so as to be free of sharp edges and transitions having small radii (0.08 in. or less) as have conventionally been used to break sharp edges or round off transitions between adjacent distinct surfaces. Although certain reference or contour lines are shown in FIGS. 3-6 to represent general transitions between one surface and another, it should be understood that the lines do not represent sharp transitions. Instead, all surfaces are preferably blended together to form the preferred continuously contoured surface and cutting profiles that are free from abrupt changes in radius. By eliminating small radii along cutting surface 103, detrimental stress concentrations in the cutting surface are substantially reduced, leading to a more durable and longer lasting cutter element.

Figure 3:
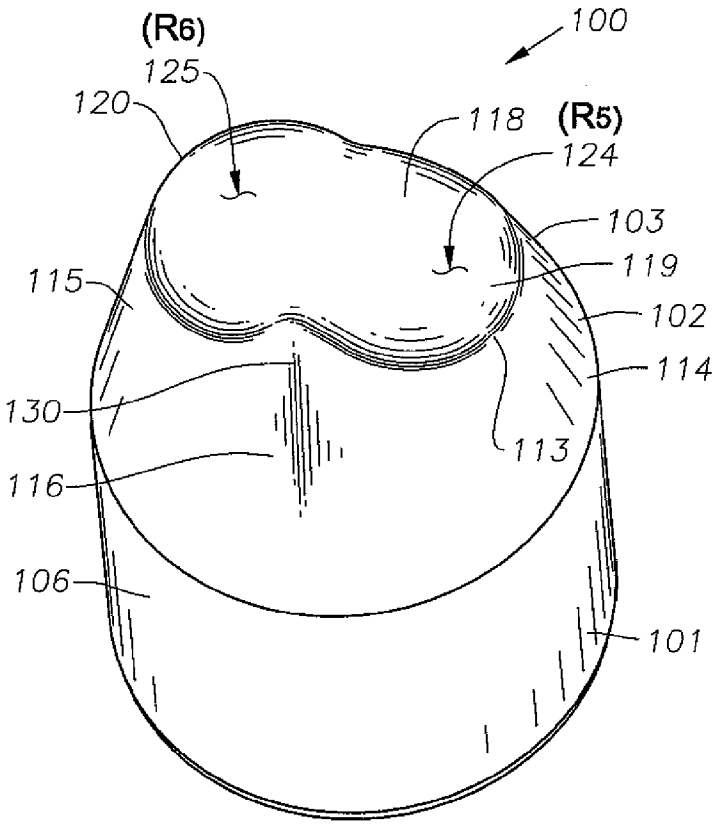
FIG. 3 is a perspective view of an embodiment of a cutter element having particular application in a rolling cone bit such as that shown in FIGS. 1 and 2.

Referring still to FIGS. 3-6, cutting surface 103 comprises a pair of generally opposed flanking surfaces 116, 117 and a pair of lateral end surfaces 114, 115. Flanking surfaces 116, 117 generally taper or incline towards each other, and taper towards insert axis 108, to form an generally elongate chisel crest 118 that extends between crest ends or corners 119, 120. As best shown in FIGS. 3 and 5, each flanking surface 116, 117 also includes a concave surface 130 that extends from proximal base portion 101 to crest 118, the concavity being most pronounced proximal crest 118. As used herein, the term "elongate" may be used to describe an insert crest whose length is greater than its maximum width in top view (FIG. 5). As will be described in more detail below, crest end 119 is generally smaller than crest end 120, and thus, crest ends 119, 120 may also be referred to herein as small crest end 119 and a large crest end 120, respectively.

Lateral end surfaces 114, 115 extend from base portion 101 to crest 115. More specifically lateral end surfaces 114, 115 extend from base portion 101 to crest ends 119, 120, respectively, and generally extend between flanking surfaces 114, 115. Lateral end surfaces 114, 115 are each generally frustoconical as they extend from base portion 101 toward crest 118. In addition, side surfaces 119, 120 are preferably blended into flanking surfaces 119, 120 and crest corners 114, 115 to form a continuously contoured cutting surface 103. As best seen in the front view of FIG. 4, lateral end surfaces 114, 115 are generally straight in profile as they extend between base portion 101 and crest 118. Likewise, as best seen in the cross-sectional view of FIG. 6, flanking surfaces 116, 117 are generally straight in profile as they extend between base portion 101 and crest 118. In other embodiments, the flanking surfaces (e.g., flanking surfaces 116, 117) and/or the end surfaces (e.g., end surfaces 114, 115) may be curved or arcuate between the base portion (e.g., base portion 101) and the crest (e.g., crest 118).

As previously described, the profiles of flanking surfaces 116, 117 and end surfaces 114, 115, are substantially straight in the region between base portion 101 and crest 118. Moving from base portion 101 towards crest 118, the transition from surfaces 114-117 to crest 118 generally occurs where the substantially straight surfaces 114-117 begin to curve. In other words, the transition from surfaces 114-117 to crest 118 occurs where the radius of curvature of surfaces 114-117 begin to change. The points at which the radius of curvature of surfaces 114-177 begin to change is denoted by a parting line 113. Thus, parting line 113 may be used to schematically define elongate crest 118 of insert 100.

Referring now to the top axial view shown in FIG. 5, in this embodiment elongate crest 118 extends substantially linearly between crest corners 122 along a crest median line 129. In general, crest 118 has a length measured along cutting surface 103 between crest ends 119, 120, and has a width measured perpendicular to crest median line 129 in top axial view. In addition, cutting surface 103 and crest 118 are each generally symmetrical about a reference plane 122 that contains insert axis 108 and crest median line 129, and that generally bisects lateral end surfaces 114, 115, and crest ends 119, 120. Although crest 118 is symmetric about plane 122 in this embodiment, the preferred shape for cutting surface 103 and crest 118 is asymmetric in all other respects, and thus, crest 118 may therefore be described herein as asymmetrical. For instance, it should be appreciated that the width of crest 118 is not constant, but rather, varies along crest median line 129.

Referring now to the front view of FIG. 4, in this embodiment crest 118 is smoothly curved along its length between crest ends 119, 120. Specifically, crest 118 is convex or bowed outward as it extends between crest ends 119, 120. In this respect, crest 118 may be described as having a convex end-to-end profile. Thus, contrary to some conventional chisel-shaped inserts that have a flat or substantially flat crest in front profile view, this embodiment of insert 100 includes a crest 118 that is curved along its length.

Referring still to FIG. 4, in this embodiment, crest ends 119, 120 are generally rounded in front profile view. In particular, small crest end 119 is defined by a small crest end radius $R_5$, and large crest end 120 is defined by a large crest end radius $R_6$ that is greater than small crest end radius $R_5$ in front view. It should be appreciated that crest end radius $R_5$ and $R_6$ each lie within reference plane 122 (FIG. 5), and consequently, provide for the rounded profiles of small and large crest ends 119, 120. In this embodiment, large crest end radius $R_6$ is preferably at least 1.1 times greater than small crest end radius $R_5$. In other instances, large crest end radius $R_6$ is at least 1.15 times greater than small crest end radius $R_5$. However, the particular value selected for crest end radii $R_5$ and $R_6$ may dependent upon a variety of factors, including without limitation, formation hardness and abrasiveness, and cutter element size, orientation, position in the cone cutter, or combinations thereof In general, with crest end radius $R_6$ being greater than crest end radius $R_5$, crest end 120 will be larger than crest end 119, and thus, provide a greater volume of insert material (such as tungsten carbide) as compared to crest end 119. Nevertheless, as shown in FIGS. 3-6, insert 100 still retains a general chisel shape, given its elongate and relatively narrow crest 118 and its tapering surfaces 114-117.

In addition, in this embodiment, crest ends 119, 120 are partial spheres, and thus, radii $R_5$ and $R_6$ also represent the spherical radii of small and large crest ends 119, 120, respectively. In other embodiments not depicted, one or both crest ends (e.g., crest ends 119, 120) may be rounded in front elevation view, but are not spherical. In the perspective view of FIG. 3, the generally spherical regions at ends 119, 120 are shown generally by reference numerals 124, 125, respectively, spherical surface 124 at the small end 119 being defined by spherical crest end radius $R_5$ and spherical surface 126 at large end 120 being defined by spherical crest end radius $R_6$ previously described.

Figure 6:
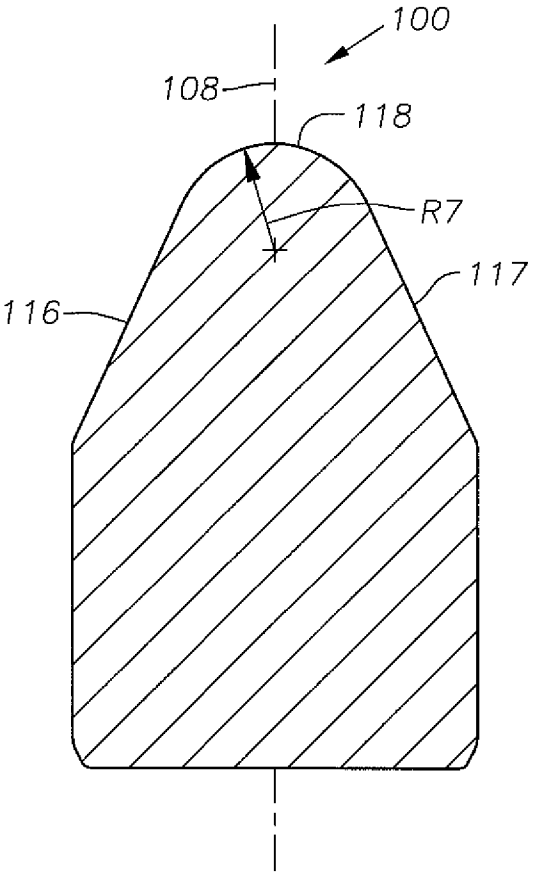
FIG. 6 is a cross-sectional view taken along plane 6-6 shown in FIG. 4.

Referring now to FIG. 6, crest 118 is also curved between flanking surfaces 116, 117. In particular, crest 118 is convex or bowed outward between flanking surfaces 116, 117. Thus, crest 118 may be described as being curved in two dimensions—convex between crest ends 119, 120 in front view (FIG. 4), and convex between flanking surfaces 116, 117 in side cross-sectional view (FIG. 5).

The curvature of crest 118 between flanking surfaces 116, 117 is defined by a transverse radius $R_7$. Although the width of crest 118 varies along its length in top view (FIG. 5), transverse radius $R_7$ is substantially constant between crest ends 119, 120 in this embodiment. As used herein, the phrase "transverse radius" refers to the radius of curvature of an elongate crest as measured between the flanking surfaces that form the elongate crest. For an embodiment of insert 100 having a base diameter 105 of 0.625 in. and an overall height 111 of 1.0 in., crest 118 has a small end radius $R_5$ of 0.160 in., a large end radius $R_6$ of 0.175 in., and a transverse radius $R_7$ of 0.145 in. Depending upon the insert's height 111, insert base diameter 105, as well as the formation being drilled and other circumstances, alternative values may be employed for radii $R_5$, $R_6$, $R_7$, provided, however, crest end radius $R_6$ is greater than crest end radius $R_5$.

Referring now to FIG. 5, crest 118 may also be described in terms of a top crest profile 132 (represented by a dashed line in FIG. 5). Top profile 132 has the general shape of a cross-section of insert 100 at a reference plane 123 (FIG. 4) that is substantially perpendicular to insert axis 108 and passes completely through crest 118. Top crest profile 132 shown in FIG. 5 is taken at reference plane 123 that intersects crest 118 at about the midpoint of the transition between crest 118 and surfaces 114-117.

In top axial view, crest profile 132 includes a crest profile radius $R_1$ at small crest end 119, and a crest profile radius $R_2$ at large crest end 120 that is larger than crest profile radius $R_1$. In the embodiment shown in FIGS. 3-6, large crest profile radius $R_2$ is preferably at least 1.1 times small crest profile radius $R_j$. In other instances, large crest profile radius $R_2$ is at least 1.15 times small crest profile radius $R_1$. It is to be understood that crest profile radius $R_1$ and $R_2$ lie in reference plane 123 previously described (FIG. 4).

Referring still to FIG. 5, top crest profile 132 includes an intermediate crest profile region 135 that is generally incident with, and defined by, concave surface 130 of each flanking surface 116, 117. Intermediate crest profile region 135 generally represents the transition between crest ends 119, 120. The curved shape of intermediate crest profile region 135 includes a concavity defined by profile transition radii $R_3$, $R_4$; radius $R_3$ being less than radius $R_4$ in this embodiment. Relative to crest profile radii $R_1$ and $R_2$ previously described, profile transition radii $R_3$, $R_4$ are inverted, such that top crest profile 132 may be described as including an inverted radius section in intermediate crest profile region 135. Profile transition radii $R_3$, $R_4$ are preferably selected such that crest 118 and top crest profile 132 are free from sharp changes in radii, resulting in a crest 118 that smoothly blends between small crest end 119 and large crest end 120. In other embodiments, profile transition radius $R_3$ is substantially the same as profile transition radius $R_4$.

Referring still to FIG. 5, small crest end 119 and large crest end 120 have crest end widths $W_1$, $W_2$, respectively, in crest profile 132. Given that crest end radius $R_6$ is greater than crest end radius $R_5$, and crest profile radius $R_2$ is greater than crest profile radius $R_1$, crest end width $W_2$ will likewise be greater than crest end width $W_1$. Still further, the narrowest portion of intermediate crest profile region 135 has a crest intermediate width $W_3$ that is less than crest end width $W_1$, and less than crest end width $W_2$. In this regard, top crest profile 132 and crest 118 may be described as having a narrowed intermediate portion between crest ends 119, 120. As previously described, in general, crest widths are measured perpendicular to crest median line 129 and reference plane 122 in top axial view.

In the manner shown and described with reference to FIGS. 3-6, the shape of cutting surface 103, and in particular crest 118, provides a generally elongate, chisel shaped and relatively aggressive insert 100 believed to have particular utility in bottomhole cutting. In addition, the volume of insert material at one of the crest ends (e.g., large crest end 120) is increased relative to the other crest end (e.g., small crest end 119), thereby offering the potential for enhanced durability at the larger crest end. As will be described in more detail below, the increased size of one of the crest ends (e.g., large crest end 120) provides the opportunity to orient the insert in a rolling cone cutter to provide particular advantages for certain formations and applications.

Figure 7:
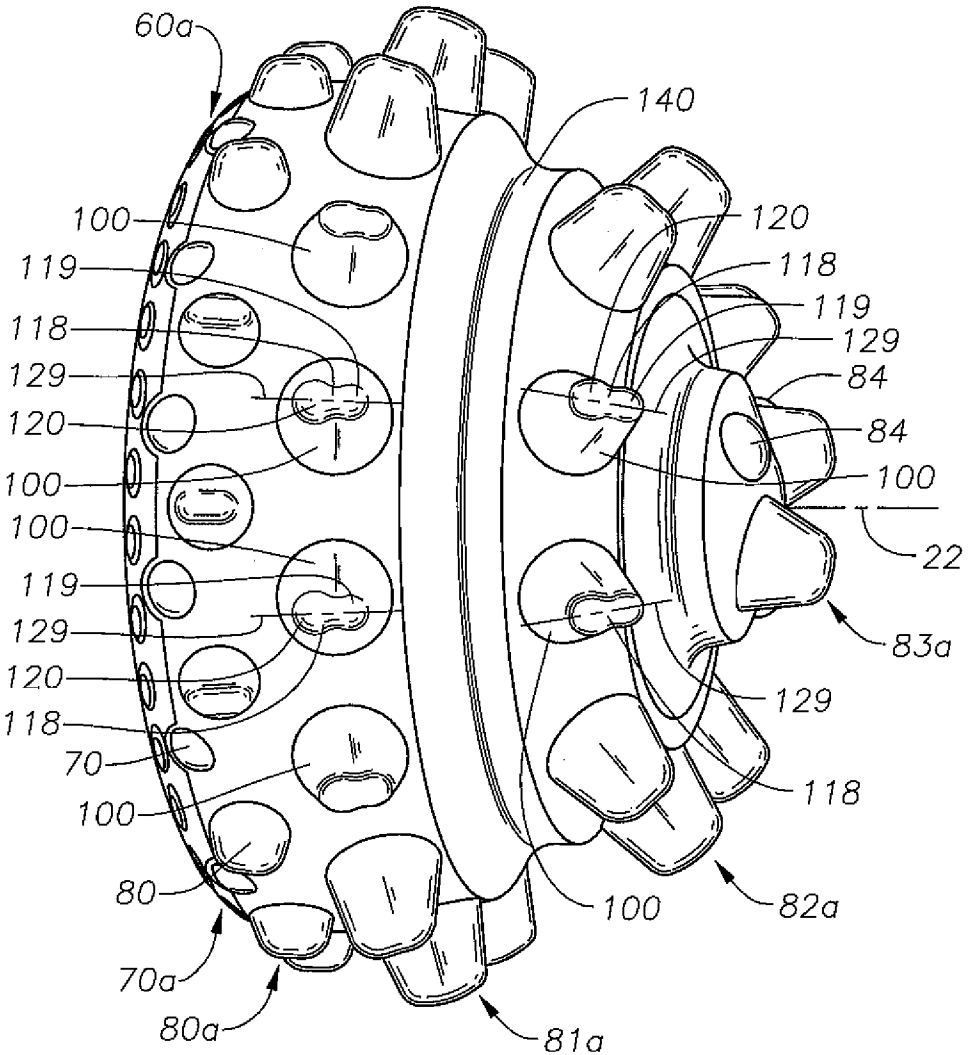
FIG. 7 is a perspective view of an embodiment of a rolling cone cutter having cutter elements of FIGS. 3-6 mounted therein.

Referring now to FIG. 7, there is shown a cone cutter 140 having mounted therein a plurality of cutter elements 100 previously described. Cone cutter 140 may be employed, for example, in drill bit 10 described above with reference to FIGS. 1 and 2, with cone cutter 140 substituted for any of cones 1-3 previously described.

Cone cutter 140 includes heel row 60*a* of heel row inserts 60, gage rows 70*a*, 80*a* of gage row cutter elements 70, 80, respectively. Inner rows 81*a* and 82*a* of cone cutter 140 are provided with a plurality of inserts 100 previously described. Cone 140 further includes a nose row 83*a* having, in this embodiment, a pair of conventional chisel-shaped insert. The nose portion 42 of cone 140 also includes ridge cutters 84 having generally dome-shaped cutting surfaces. Using a commonly employed nomenclature, row 81*a* may be referred to herein as a "staggered" row. A staggered row is generally the row immediately adjacent and radially inward (relative to the bit axis) from the gage inserts that extend to full gage diameter—gage rows 70*a*, 80*a* of gage row cutter elements 70, 80, respectively in this example. Likewise, row 82*a* may be referred to herein as a "drive" row as it is the inner row immediately adjacent to the nose row and spaced radially away from the nose row (relative to the bit axis).

As shown in the embodiment of FIG. 7, inserts 100 employed in rows 81*a* and 82*a* are mounted in cone cutter 140 such that a projection of each crest median line 129 is aligned with and intersects cone axis 22. In addition, inserts 100 employed in rows 81*a* and 82*a* are oriented such that each large crest end 120 is proximal the borehole sidewall and each small crest end 119 is distal the borehole sidewall. More specifically, large crest end 120 of each crest 118 is positioned closer to the borehole sidewall than small end 119 when cutter element 100 is at its radially-outermost position with respect to bit axis (e.g., bit axis 11). Consequently, small crest end 119 is closer to the bit axis than large crest end 120.

Insert 100 may be mounted in locations and orientations other than those shown in FIG. 7. In general, the orientation of insert 100 may change depending on a variety of factors including, without limitation, the drilling practices being employed, the formation hardness, or combinations thereof. The embodiment shown in FIG. 7 is believed advantageous in providing enhanced insert and bit durability in hard or abrasive formations. In such formations, gage row cutter elements 70, 80 may significantly wear, causing inserts 100 in staggered row 81*a* to take on a greater sidewall cutting duty. By positioning the larger crest end 120 adjacent the borehole sidewall, a more robust, durable, and wear resistant cutting structure is presented to the borehole sidewall than would be the case if crest end 120 was the same size as small crest end 119. In particular, it is believed that large crest end 120 may endure significant abrasion and wear before ROP is detrimentally affected. Further, providing the small crest end 119 radially inward relative to the large crest end 120 provides cutter elements 100 having relatively sharp and aggressive inwardly-positioned crest ends that are particularly advantageous for bottomhole cutting. Although inserts 100 are also shown employed in drive row 82*a* in the example shown in FIG. 7, conventional conical or chisel-shaped inserts or other conventional inserts may alternatively be used in this row.

Figure 8A:
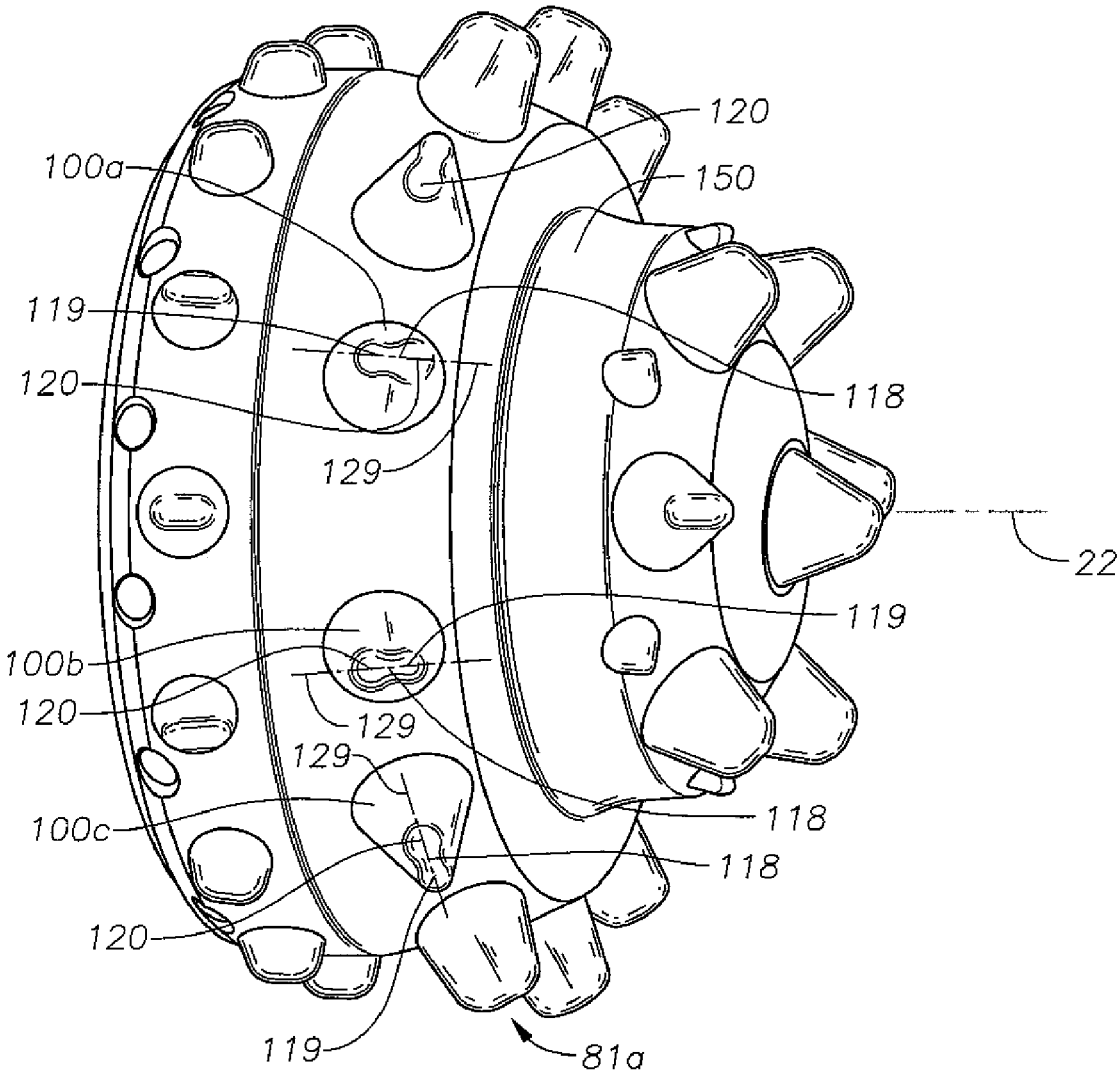
FIG. 8A is a perspective view of an embodiment of a rolling cone cutter having cutter elements of FIGS. 3-6 mounted in an alternative arrangement.

Referring now to FIG. 8A, another embodiment of a cone cutter 150 is shown having a plurality of inserts 100 previously described mounted in staggered row 81*a*. In this embodiment, inserts 100 of row 81*a* are not uniformly mounted or oriented alike. Rather, inserts 100 are mounted in a plurality of non-uniform orientations within row 81*a*. For instance, insert 100*a* is mounted with crest median line 129 generally aligned cone axis 22, small crest end 119 positioned proximal the borehole sidewall and large crest end 120 positioned distal the borehole sidewall (i.e., proximal the bit). However, adjacent insert 100*b* in staggered row 81*a* is oppositely oriented with crest median line 129 generally aligned with cone axis 22, large crest end 120 positioned proximal the borehole wall as was described in the embodiment shown in FIG. 7. Still further, the next adjacent insert 100*c* is mounted with its crest 118 and crest median line 129 rotated 90° relative to the orientation of inserts 100*a*, 100*b*. An arrangement of inserts 100 non-uniformly oriented such as that shown in FIG. 8A may be particularly desirable in instances where it is known that a number of differing formation hardnesses will be encountered.

Figure 8B:
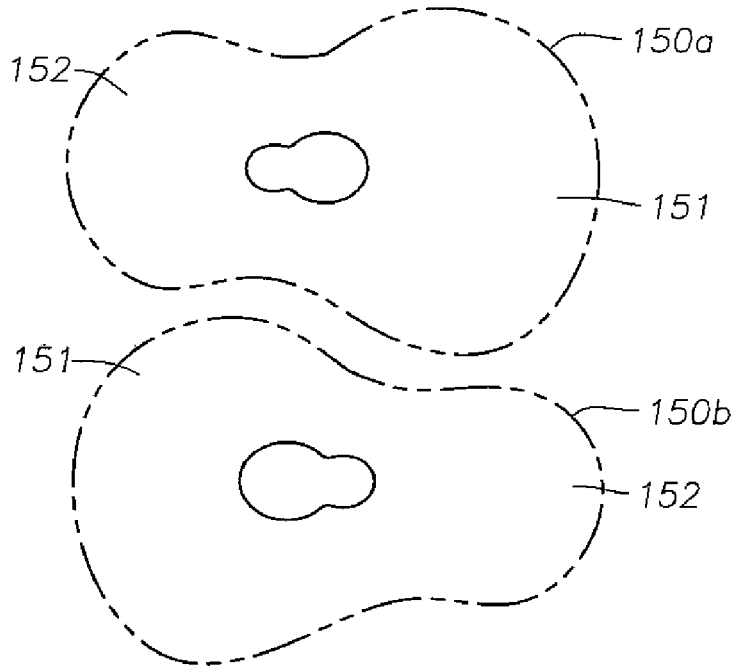
FIG. 8B is a schematic representation illustrating the general shape of the impact craters that may be formed in the formation by the cutter elements of the cone cutter shown in FIG. 8A.

The particular orientation of each crest 118 relative to other crests 118 may be designed and configured to potentially enhance formation removal and ROP. For instance, referring to FIG. 8B, a schematic representation of a pair of impact craters 150*a*, 150*b* formed in the formation by adjacent inserts 100*a*, 100*b*, respectively (FIG. 8A), are shown. Impact craters 150*a*, 150*b* each include a larger crater lobe 151 formed by the impact of larger crest end 120, and a smaller crater lobe 152 formed by the impact of smaller crest end 119. As shown in FIG. 8B, large crest ends 120 of inserts 100*a*, 100*b* remove a larger amount of formation material as compared to small crest ends 119. By orienting crests 118 of inserts 100*a*, 100*b* as shown in FIG. 8A, complementary shaped craters 150*a*, 150*b* are formed with large lobes 151 generally adjacent small lobes 152. Providing inserts shaped and oriented to remove formation material via complementary-shaped craters offers the potential for increased formation removal and enhanced ROP. Thus, the orientation of each insert 100 in a row on a cone cutter may be oriented such that small crest ends 119 and large crest ends 120 are oriented relative to each other to maximize bit durability and ROP based on the formation characteristics and the drilling application.

The embodiments of insert 100 described thus far have included an elongate crest 118 formed by surfaces 114-117. The top crest profile 132 of insert 100 includes an intermediate profile region 135 disposed between the crest ends 119, 120 that is generally smoothly curved and blends with both the adjacent large crest end 120 and the adjacent small crest end 119. However, in other embodiments, the intermediate profile region may take other shapes. For example, referring now to FIG. 9, there is shown a top view of an alternative embodiment of an insert 160 including a generally elongate chisel-shaped crest 161 having top crest profile 162.As shown, crest 160 and top crest profile 162 include a relatively small first crest end 163 and a relatively large second crest end 164. Small crest end 163 and large crest end 164 are each curved as represented by crest profile radii $R_1$, $R_2$, respectively. As in the previous embodiments, large crest profile radius $R_2$ is greater than small crest profile radius $R_1$. In this embodiment, however, the central or intermediate profile region 165 of top crest profile 162 forms generally V-shaped valleys 166 between crest ends 163, 164. Because the transition between crest ends 163, 164 is sharper at valley 166 (i.e., has a smaller radius of curvature) as compared to, for example, the curved intermediate profile region 135 shown in FIG. 5. As a result, the stress concentrations at valleys 166 of insert 160 will tend to be greater than the stress concentrations at intermediate profile regions 135 of insert 100 shown in FIG. 5. Nevertheless, in certain applications, such increased stresses may be tolerable.

Figure 9:
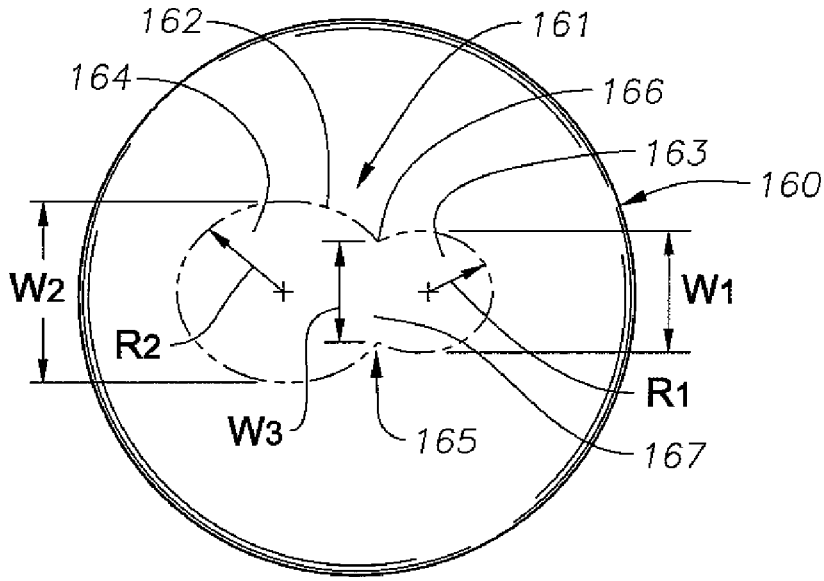
FIG. 9 is a top view, similar to FIG. 5, showing the crest and top cutting profile of an embodiment of a cutter element.

Referring still to FIG. 9, small crest end 163 has a width $W_1$ and large crest end 164 has a width $W_2$ that is larger than width $W_1$. Between valleys 166, intermediate profile region 165 has a width $W_3$ that is less than both width $W_1$ and width $W_2$.

Figure 10:
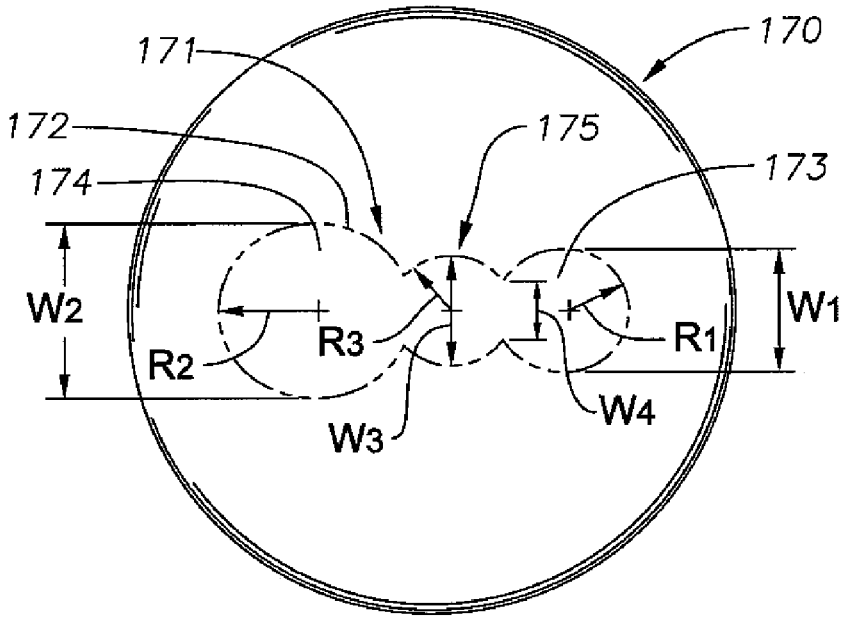
FIG. 10 is a top view, similar to FIG. 9, showing the crest and top cutting profile of an embodiment of a cutter element.

Referring now to FIG. 10, another embodiment of a cutter element or insert 170 having a cutting portion terminating in a generally elongate, chisel-shaped crest 171 is shown. Crest 171 extends between a small crest end 173 and a large crest end 174. Crest 171 includes a top crest profile 172 having a large crest profile radius $R_2$ at large crest end 174, and a small crest profile radius $R_1$ at small crest end 173, wherein profile radius $R_2$ is greater than profile radius $R_1$. Likewise, the width $W_2$ of large crest end 174 is greater than the width $W_1$ of small crest end 173.

Between crest ends 173, 174, top crest profile 172 includes an intermediate profile portion 175 having a maximum width $W_3$ and a minimum width $W_4$, each of which are less than width $W_2$ in this embodiment. As shown, intermediate portion 175 is defined by an intermediate profile radius $R_3$. In general, profile radius $R_3$ may be greater than, less than, or equal to crest profile radius $R_1$ or crest profile radius $R_2$, and these radius will vary depending upon, for example, the distance between small crest end 173 and large crest end 174. However, width $W_2$ is preferably greater than width $W_1$, and profile radius $R_2$ is preferably greater than profile radius $R_1$.

Figure 11:
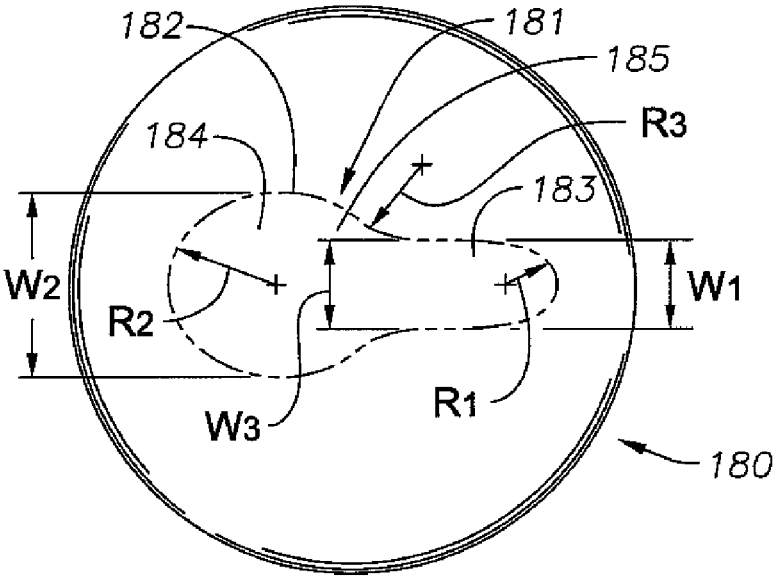
FIG. 11 is a top view, similar to FIG. 9, showing the crest and top cutting profile of an embodiment of cutter element.

Referring now to FIG. 11, another embodiment of an insert 180 having a crest 181 is shown. Crest 181 has a top crest profile 182, and includes a small crest end 183 defined by a crest profile radius $R_1$ and a large crest end 184 defined by a crest profile radius $R_2$ that is greater than profile radius $R_1$. Likewise, width $W_2$ of large crest end 182 is greater than width $W_1$ of small crest end 183. Between crest ends 182, 183, crest profile 182 includes an intermediate portion 185 in which an inverted profile radius $R_3$ defines the smoothly curved transition between crest ends 182, 183. In this embodiment, width $W_1$ of small crest end 183 is substantially the same as width $W_3$ of intermediate portion 185, each being less than width $W_2$ of large crest end 182.

As understood with reference to FIGS. 9-11, the intermediate region or portion of the top crest profile extending between the small crest end and the large crest end of the insert crest may be configured in a number of ways to transition between the crest ends. In general, inserts 160, 170, 180 of FIGS. 9-11, respectively, may be positioned anywhere as desired in a rolling cone cutter; however, in at least one principal application, such embodiments are positioned with the larger crest end proximal the borehole sidewall at the insert's closest approach to the borehole sidewall. As previously described with reference to insert 100, such an orientation offers the potential for increased protection against off-center wear in the event that the cutter elements extending to full gage substantially wear, in which case, the next adjacent inner row of cutter elements begin to take on an increased borehole sidewall cutting duty. However, it should also be appreciated that inserts 160, 170, 180 maintain a relatively aggressive and generally elongate, chisel-shaped crest particularly suited for bottomhole formation removal.

Figure 12A:
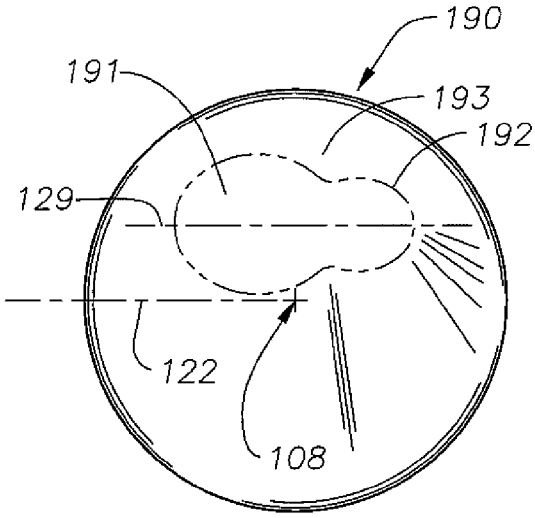
FIGS. 12A and 12B are top views, similar to FIG. 9, showing the crest and top cutting profile of embodiments of cutter elements, where the crest is offset from the cutter element axis in different directions.

Referring now to FIG. 12A, an embodiment of a cutter element or insert 190 is shown. Insert 190 includes an elongate, chisel-shaped crest 191 extending along a crest median line 129. Crest 191 has a top crest profile 192 that is offset from insert axis 108 in a direction generally perpendicular to reference plane 122. In other words, crest median line 129 is parallel with reference plane 122, but offset laterally from reference plane 122. As a result, cutting surface 193 of insert 190 is tilted or canted away from the reference plane 122 containing cutter element axis 108.

Figure 12B:
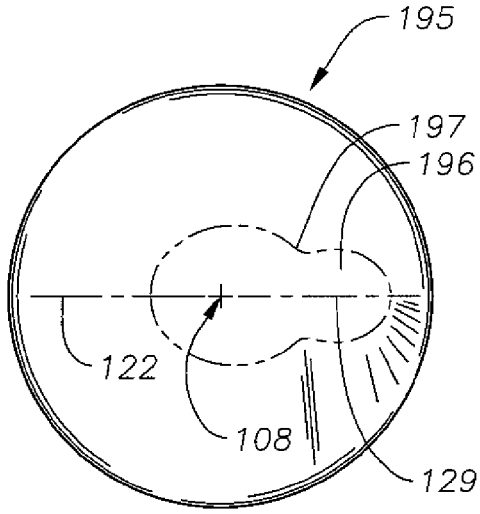

In FIG. 12B, an insert 195 includes an elongate crest 196 extending along a crest median line 129. Crest 196 has a top crest profile 197 that is offset from insert axis 108 in a direction parallel to reference plane 122. In other embodiments, the elongate crest 195 may be offset from insert axis 108 in a direction parallel and perpendicular to reference plane 122.

Figure 13:
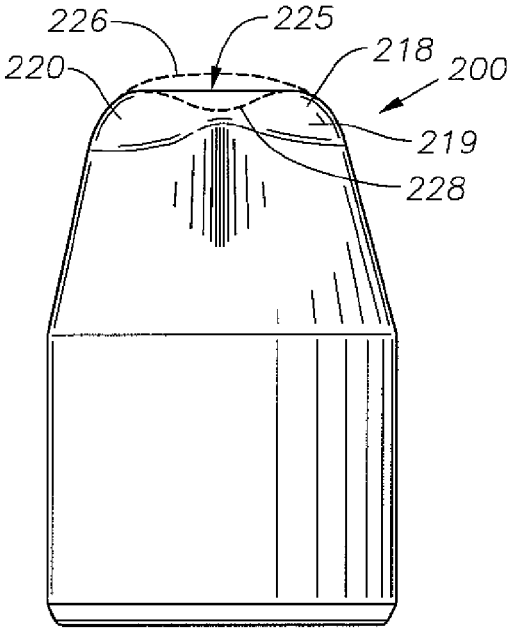
FIG. 13 is a front elevation view, similar to FIG. 4, of an embodiment of a cutter element.

Referring now to FIG. 13, another embodiment of an insert 200 includes an elongate crest 218 extending between a small crest end 219 and a large crest end 220. Crest 218 is substantially similar to crest 118 previously described with reference to FIGS. 3-6. However, in this embodiment, crest 218 does not have a generally concave end-to-end profile between crest ends 219, 220 in front view, but rather, is substantially flat between small crest end 219 and large crest end 220. In particular, the intermediate portion 225 of crest 218 between crest ends 219, 220 is not convex as viewed in side profile of FIG. 13, but is substantially flat. For comparison purposes, dashed line 226 corresponds to the convex side profile of crest 118 of cutter element 100 previously described. Further, as represented by dashed line 228, in other embodiments, the intermediate portion 225 of crest 218 may be concave in side profile such that small end 219 and large end 220 each have a height that is greater than the height of intermediate portion 225 relative to the base portion.

Figure 14:
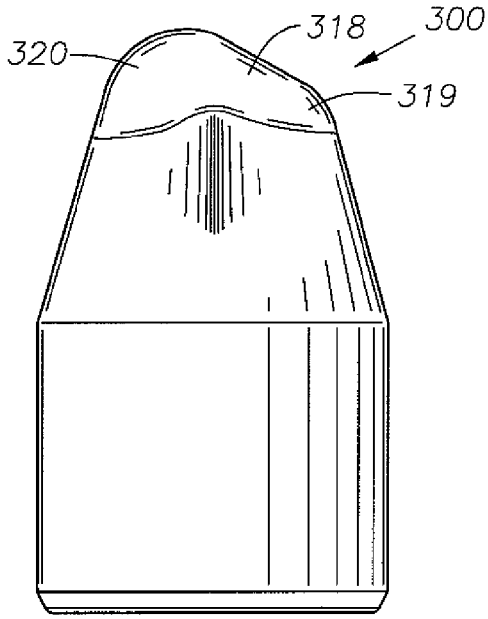
FIG. 14 is a front elevation view, similar to FIG. 13, of an embodiment of a cutter element.

Referring now to FIG. 14, an alternative embodiment of an insert 300 is shown having an elongate crest 318 with small and large radiused crest ends 319, 320. Insert 300 is substantially similar to insert 100 previously described. However, in this embodiment, crest 318 slopes between large crest end 320 and small crest end 319. In particular, moving from large crest end 320 towards small crest end 319, crest 318 slopes generally downward toward the base portion. Consequently, the extension height of insert 300 is defined by large crest end 320.

In another alternative embodiment, not depicted, the crest (e.g., crest 318) may slope downward moving from the small crest end (e.g., small crest end 319) toward the large crest end (e.g., large crest end 320). With such an insert oriented in a cone cutter with large crest end 320 proximal the borehole sidewall, the increased extension height of small crest end 319 and the smaller, more aggressive radius of small crest end 319 offers the potential for enhanced bottomhole cutting while the larger, more robust crest end 320 offers the potential for enhanced abrasion resistance and durability during sidewall cutting.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit, comprising:

a base portion;

a cutting portion extending from the base portion and terminating in an elongate crest extending between a first crest end and a second crest end, and having an intermediate portion therebetween;

wherein the crest includes an end-to-end profile that is convex or substantially flat in front view;

wherein, in top view, the first crest end has a width $W_1$ and the second end has a width $W_2$ that is greater than the width $W_1$; and wherein the intermediate portion of the crest has a width $W_3$ that is less than the width $W_2$ and less than or equal to the width $W_1$.

2. The cutter element of claim 1 wherein the first crest end and the second crest end each have a crest end radius in front view, and wherein the crest end radius of the first crest end is smaller than the crest end radius of the second crest end.

3. The cutter element of claim 2 wherein the crest further comprises a top crest profile in top view comprising a first profile end defined by the first crest and a second profile end defined by the second crest, wherein the first profile end has a profile radius $R_1$ in top view and the second profile end has a crest profile radius $R_2$ in top view, and wherein the profile radius $R_2$ is greater than the profile radius $R_1$.

4. The cutter element of claim 3 wherein the top crest profile further includes a curved intermediate profile region between the first profile end and the second profile end, wherein the intermediate profile region is defined by an intermediate profile radius $R_3$ that is inverted relative to profile radius $R_2$.

5. The cutter element of claim 2 wherein the top crest profile includes an intermediate profile region between the first profile end and the second profile end, wherein the intermediate profile region includes a V-shaped valley in top view.

6. The cutter element of claim 1 wherein the crest includes an end-to-end profile that is convex in front view.

7. The cutter element of claim 1 further comprising a cutter element axis, wherein the first crest end and the second crest end extend to different heights from the base portion as measured parallel to the cutter element axis.

8. The cutter element of claim 1 further comprising a cutter element axis, wherein the crest is offset from the cutter element axis in top view.

9. The cutter element of claim 1 wherein width $W_3$ is less than width $W_1$.

10. The cutter element of claim 2 wherein the crest end radius of the second crest end is at least 10% larger than the crest end radius of the first crest end.

11. The cutter element of claim 2 wherein the first crest end and the second crest end are partial spheres, each having a spherical radius, and wherein the spherical radius of the first crest end is equal to the crest end radius of the first crest end and the spherical radius of the second crest end is equal to the crest end radius of the second crest end.

12. A cutter element for a drill bit, comprising:

a base portion including a cutter element axis;

a cutting portion extending from the base portion and terminating in an elongate crest having a top crest profile in top view, the top crest profile comprising a first profile end, a second profile end, and an intermediate profile region therebetween;

wherein the first profile end has a profile radius $R_1$ and the second profile end has a profile radius $R_2$ that is greater than the profile radius $R_1$;

wherein the intermediate profile region of the top crest profile includes a concave portion defined by at least one radius that is inverted relative to the profile radius $R_1$ and the profile radius $R_2$; and wherein the elongate crest further includes an end-to-end profile that is convex or substantially flat in front view.

13. The cutter element of claim 12 wherein the profile radius $R_2$ is at least 1.1 times the profile radius $R_1$.

14. The cutter element of claim 12 wherein the elongate crest extends between a first crest end and a second crest end, wherein the first crest end and the second crest end each have a crest end radius in front view, wherein the crest end radius of the second crest end is at least 1.1 times larger than the crest end radius of the first crest end.

15. The cutter element of claim 14 wherein the crest end radius of the second crest is at least 1.15 times greater than the crest end radius of the first crest end.

16. The cutter element of claim 12 wherein the first profile end has a width $W_1$ and the second profile end has a width $W_2$ that is at least 1.1 times greater than width $W_1$.

17. The cutter element of claim 16 wherein the intermediate profile region has a width $W_3$, that is less than width $W_1$.

18. The cutter element of claim 12 wherein one of the first and second crest ends extends farther from the base portion than the other of the crest ends as measured parallel to the cutter element axis.

19. The cutter element of claim 18 wherein the second crest end defines extends farther than the first crest end from the base portion as measured parallel to the cutter element axis.

20. The cutter element of claim 16 wherein the crest is offset from the cutter element axis.

21. The cutter element of claim 12 wherein the cutting portion includes a cutting surface having a concave region positioned between the base portion and the crest, and wherein the concave region defines the shape of the concave portion of the intermediate profile region of the top crest profile.

22. The cutter element of claim 12 further comprising a cutting surface including a pair of frustoconical lateral end surfaces that taper toward the cutter element axis as they extend from the base portion toward the crest, and including a pair of flanking surfaces, each flanking surface disposed between the lateral end surfaces and tapering toward the cutter element axis as they extend from the base portion toward the crest.

23. The cutter element of claim 12 wherein the crest end radius of the first crest end and the crest end radius of the second crest end are both spherical radii.

24. The cutter element of claim 14 wherein the crest includes an end-to-end profile that is convex in front view.

25. A drill bit for drilling a borehole having a predetermined full gage diameter, the bit comprising:

a bit body having a bit axis;

a first rolling cone cutter rotatably mounted on the bit body for rotation about a cone axis;

at least one cutter element mounted on the first rolling cone cutter, wherein the cutter element comprises a cutting surface including a pair of frustoconical lateral end surfaces and at least one flanking surface disposed between the lateral end surfaces, the first and second end surfaces and the flanking surface intersecting to form an elongate crest having a first crest end and a second crest end;

wherein the crest defines a top crest profile having a width $W_1$ at the first crest end, a width $W_2$ at the second crest end, and a width $W_3$ at an intermediate profile region between the first crest end and the second crest end;

wherein width $W_2$ is greater than width $W_1$ and greater than width $W_3$, and wherein width $W_3$ is less than or equal to $W_1$; and wherein the elongate crest further includes an end-to-end profile that is convex or substantially flat in front view.

26. The drill bit of claim 25 wherein the at least one cutter element is oriented in the first rolling cone cutter such that the second crest end is positioned closer to the borehole sidewall than the first crest end when the cutter element is at its radially outermost position with respect to the bit axis.

27. The drill bit of claim 26 wherein the at least one cutter element is mounted in the first rolling cone cutter such that the cutting surface extends to less than the full gage diameter.

28. The drill bit of claim 27 wherein the at least one cutter element is mounted in a drive row of the first rolling cone cutter.

29. The drill bit of claim 25 wherein the crest extends along a crest median line in top view, and wherein the at least one cutter element is mounted in the first rolling cone cutter such that a projection of the crest median line intersects the cone axis.

30. The drill bit of claim 25 wherein the crest extends along a crest median line in top view, and wherein the at least one cutter element is mounted in the first rolling cone cutter such that crest median line is skewed with respect to the cone axis.

31. The drill bit of claim 30 wherein the at least one cutter element is mounted and oriented in the first rolling cone cutter such that a projection of the crest axis is substantially perpendicular to the cone axis.

32. The drill bit of claim 25 comprising a plurality of cutter elements mounted to the first rolling cone cutter;

wherein a first set of the plurality of cutter elements each have an elongate crest extending between a first crest end and a second crest end, and wherein the crest of each cutter element of the first set defines a top crest profile having a width $W_1$ at the first crest end, a width $W_2$ at the second crest end, and a width $W_3$ at an intermediate profile region between the first crest end and the second crest end; and wherein width $W_2$ is greater than width $W_1$ and greater than width $W_3$, and wherein width $W_3$ is less than or equal to $W_1$.

33. The drill bit of claim 32 wherein the first set of cutter elements are arranged in a circumferential row.

34. The drill bit of claim 33 wherein the crest of each of the first set of cutter elements extends along a crest median line, wherein each of the first set of cutter elements are positioned and oriented in the first rolling cone cutter such that the crest median line of each of the first set of cutter elements is aligned with the cone axis.

35. The drill bit of claim 33 wherein the crest of each of the first set of cutter elements extends along a crest median line, wherein each of the first set of cutter elements are positioned and oriented in the first rolling cone cutter such that the crest median line of at least two cutter elements of the first set of cutter elements are non-uniformly arranged relative to the cone axis.

36. A drill bit having a gage diameter for drilling a borehole in earthen formations, the bit comprising:

a bit body having a bit axis;

a rolling cone cutter rotatably mounted on the bit body for rotation about a cone axis;

a first plurality of cutter elements mounted on the rolling cone cutter, each of the first plurality of cutter elements having a base portion retained in the cone cutter and a cutting portion extending from the base and terminating in an elongate crest extending along a crest median line between a first crest end and a second crest end, and having an intermediate portion between the first crest end and the second crest end;

wherein each of the first and second crest ends has a crest end radius in front view, and wherein the crest end radius of the first crest end is smaller than the crest end radius of the second crest ends;

wherein the elongate crest further includes an end-to-end profile that is convex or substantially flat in front view.

37. The drill bit of claim 36 wherein the second crest end radius is at least 1.10 times greater than the first crest end radius.

38. The drill bit of claim 37 wherein the second crest end radius is at least 1.15 times greater than the first crest end radius.

39. The drill bit of claim 37 wherein the crest end radii of the first crest end and the second crest end are each spherical radii.

40. The drill bit of claim 36 wherein at least one of the first plurality of cutter elements is an inner row cutter element mounted in the cone and oriented such that the second crest end is closer to the borehole sidewall than the first crest end when the cutter element is at its radially outermost position with respect to the bit axis.

41. The drill bit of claim 36 wherein the first plurality of cutter elements are mounted in at least two spaced-apart circumferential rows on the rolling cone cutter.

42. The drill bit of claim 36 wherein at least one of the first plurality of cutter elements is mounted to the rolling cone cutter such that a projection of the crest median line is substantially aligned with the cone axis.

43. The drill bit of claim 36 wherein at least one of the first plurality of cutter elements is mounted to the rolling cone cutter such that a projection of the crest median line skewed relative to the cone axis.

44. The drill bit of claim 36 wherein the first plurality of cutter elements are mounted to the rolling cone cutter such that at least two of the crests of the first plurality of cutter elements are oriented differently relative to the cone axis.

45. A drill bit for drilling a borehole having a predetermined full gage diameter, the bit comprising:

a bit body having a bit axis;

a first rolling cone cutter rotatably mounted on the bit body for rotation about a cone axis; and at least one cutter element mounted on the first rolling cone cutter, wherein the cutter element comprises a cutting surface including a pair of frustoconical lateral end surfaces and at least one flanking surface disposed between the lateral end surfaces, the first and second end surfaces and the flanking surface intersecting to form an elongate crest having a first crest end and a second crest end;

wherein the crest defines a top crest profile having a width $W_1$ at the first crest end, a width $W_2$ at the second crest end, and a width $W_3$ at an intermediate profile region between the first crest end and the second crest end;

wherein width $W_2$ is greater than width $W_1$ and greater than width $W_3$, and wherein width $W_3$ is less than or equal to $W_1$; and wherein the at least one cutter element is mounted in an inner row and oriented in the first rolling cone cutter such that the second crest end is positioned closer to the borehole sidewall than the first crest end when the cutter element is at its radially outermost position with respect to the bit axis.

46. The drill bit of claim 45 wherein the at least one cutter element is mounted in the first rolling cone cutter in a staggered row.

47. A drill bit having a gage diameter for drilling a borehole in earthen formations, the bit comprising:

a bit body having a bit axis;

a rolling cone cutter rotatably mounted on the bit body for rotation about a cone axis;

a first plurality of cutter elements mounted on the rolling cone cutter, each of the first plurality of cutter elements having a base portion retained in the cone cutter and a cutting portion extending from the base and terminating in an elongate crest extending along a crest median line between a first crest end and a second crest end, and having an intermediate portion between the first crest end and the second crest end;

wherein each of the first and second crest ends has a crest end radius in front view, and wherein the crest end radius of the first crest end is smaller than the crest end radius of the second crest end; and wherein at least one of the first plurality of cutter elements is an inner row cutter element mounted in the cone and oriented such that the second crest end is closer to the borehole sidewall than the first crest end when the cutter element is at its radially outermost position with respect to the bit axis.

48. The drill bit of claim 47 wherein the second crest end radius is at least 1.15 times greater than the first crest end radius.

49. The drill bit of claim 47 wherein the at least one of the first plurality of cutter elements is mounted in a staggered row of the cone.

* * * * *